US005419270A

United States Patent [19]

Berge

[11] Patent Number: 5,419,270

[45] Date of Patent: May 30, 1995

[54] ARRANGEMENT OF A SUBMERSIBLE PUMP

[75] Inventor: Magne O. Berge, Paradis, Norway

[73] Assignee: Frank Mohn Fusa A/S, Fusa, Norway

[21] Appl. No.: 170,243

[22] PCT Filed: Jun. 26, 1992

[86] PCT No.: PCT/NO92/00113

§ 371 Date: Dec. 27, 1993

§ 102(e) Date: Dec. 27, 1993

[87] PCT Pub. No.: WO93/00260

PCT Pub. Date: Jan. 7, 1993

[30] Foreign Application Priority Data

Jun. 28, 1991 [NO] Norway ..... 912547

[51] Int. Cl.[6] ..... B63B 25/08

[52] U.S. Cl. ..... 114/74 R; 62/240; 165/42

[58] Field of Search ..... 114/74 R, 74 T, 74 A, 114/211; 62/240; 165/42

[56] References Cited

U.S. PATENT DOCUMENTS 3,149,472 9/1964 McCall et al. ..... 114/74 A
3,304,877 2/1967 Carter et al. ..... 114/74 R

FOREIGN PATENT DOCUMENTS 123115 9/1973 Norway .
320287 2/1970 Sweden .
1235228 6/1979 United Kingdom .

*Primary Examiner*—Jesus D. Sotelo
*Attorney, Agent, or Firm*—Francis C. Hand

[57] ABSTRACT

The pump is submerged in the tank of a ship for circulation of a liquid cargo medium within the tank through a cargo refrigeration arrangement. The pump is formed of three components. One component is mounted in the tank or hold of the ship and includes a stator and a dependent annular cooling element. The second component is removably mounted on the first component and includes a cylindrical support and a rotor which depends from the support within the stator. The third component is removably mounted on the second component and includes a drive within the cylindrical support for effecting rotation of the rotor, for example, through a magnetic coupling.

12 Claims, 3 Drawing Sheets

ARRANGEMENT OF A SUBMERSIBLE PUMP

The present invention relates to an arrangement of a submersible pump. More particularly, this invention relates to a pump for use submerged in the cargo in a ship's tank, for example for circulation of the cargo in the tank and particularly for circulation of the cargo through a cargo refrigeration arrangement which is submerged in the cargo.

Submersible pumps are known for example from NO 123 115, where the whole pump unit, that is to say the pump's drive motor with drive medium conduits, drive shaft and pump rotor ant pump stator, is submerged in the cargo in a ship's tank. By means of a drainage controlled "cofferdam"-system and an associated control system one can protect the cargo by preventing the drive medium, lubricating medium, and the like from being admixed with the cargo medium. Correspondingly the pump and its drive arrangement can be protected by preventing the cargo medium from penetrating the drive medium and the lubricating medium. Pumps of this type are especially designed for discharging cargo from cargo tanks of the ship, in which the pump is submerged. The pump unit has however also been employed in addition for circulation of the cargo medium in the cargo tank, for example in connection with separate heating cycles for heating of the cargo medium or cooling cycles for refrigerating the cargo medium. In such cases there is the possibility of keeping the cargo medium under circulation within the cargo tank, but for special reasons the heating system and the refrigeration system are placed on deck.

With the present invention the aim is a pump which is more particularly designed for circulation of the cargo medium within the cargo tank. The aim is especially a pump which can be used in connection with cooling of the cargo medium in connection with a cargo refrigeration arrangement which is submerged in the tank.

Various proposals have been submitted for circulation arrangements with portions of the circulation conduits together with the pump arranged on deck. In addition, the heating arrangement and the refrigeration arrangements have also been placed on deck. For special use purposes, such a positioning on deck is heat technically unfavourable or directly undesired, for one thing as a consequence of the more or less uncontrolled temperature influence which the circulation medium can be exposed to in the means which are arranged on deck. In addition, large problems can be encountered in achieving sufficiently hermetic transfers between equipment arranged on deck and equipment submerged in the tank. On the other hand problems can be encountered in getting the heating or refrigeration equipment clean in such cases where the heating or refrigeration equipment is submerged in the cargo medium, as a result of problems with the complicated dismantling of the equipment.

According to the invention the aim is to arrange the whole circulation system and the whole pump unit at a level below the upper level of the cargo medium in the cargo tank, so that the circulation of the cargo medium via the pump can be carried out entirely below deck at an arbitrary level in the cargo tank, so that the temperature regulation of the cargo medium can be carried out in a better controlled manner by simple means in the cargo tank and furthermore so that the equipment is relatively easy to dismantle.

At the same time the objective is to provide a simple constructional solution for preventing the mixing together of cargo medium and drive medium/lubricating medium.

In addition, the aim is a solution with a short shaft connection between the rotor of the pump and the drive arrangement of the pump. More particularly, the aim is a solution where the drive arrangement of the pump can be handled separately in an especially simple manner on mounting and dismounting, so that contamination of the cargo medium with the drive medium/lubricating medium can be avoided. Furthermore the objective is that on mounting and dismounting, the rotor of the pump can be handled together with the drive arrangement and separately relative to the stator of the pump.

In other words the aim is to divide up the pump into three separate handleable components: 1) drive arrangement, 2) pump rotor and 3) pump stator, which can be handled either as a combined unit or as step-by-step uncoupleable units. There is hereby the possibility of being able to dismount the most vital and most readily vulnerable parts i.e. the drive arrangement pump rotor relative to a more robust, more stationarily submerged part i.e. the pump stator with associated circulation system. In the same connection, the aim is also to remove in a simple manner the more robust, more stationarily submersible part from the cargo tank, when there is a need for this.

The arrangement according to the invention is characterised in that the rotor of the pump and the drive arrangement of the pump, which are arranged relative to the ship's tank as a separately mountable and dismountable unit, are carried by a common, well-forming support means, which internally is exposed to atmospheric pressure and which externally is submerged in the ship's tank. The drive arrangement of the pump is received internally in the support means and arranged at its lower well bottom, while the rotor of the pump is fastened externally on the support means, on the opposite side of the well bottom. The drive arrangement of the pump is separately mountably and dismountably fastened in the support means. The stator of the pump (pump housing and the like) forms part of a further separately fastened construction component which is submerged in the ship's tank just below the well-forming support means and which comprises a circulation system, such as a cargo refrigeration system.

By simple means there is hereby the possibility of being able to lift the more vital components, which comprise the drive arrangement (and support means) of the pump together with the pump's rotor, from the tank up on deck for examination (inspection/repair) independently of the pump's stator with associated circulation arrangement. This can be done in an easy manner, even if the pump's stator with associated circulation arrangement is arranged submerged to an arbitrarily deep level in the cargo tank of the ship.

A special advantage is that the drive arrangement can be withdrawn separately from the support means for examination, without opening the connection between the cargo tank and the atmosphere, something which is of particular importance with cargo media which must be kept hermetically isolated from the surroundings.

Especially in connection with a special field of application —where it is important to prevent physical contact between the cargo medium and the drive medium/lubricating medium and where in addition it is important that the cargo is kept hermetically closed off from connections to the atmosphere—it is preferred that the well-forming support means constitutes a closed container relative to the cargo. In this case, the drive arrangement of the pump and the rotor of the pump, which are physically isolated from each other via the bottom of the well, are drive-connected to each other by means of magnet coupling members.

By simple means it is hereby possible to arrange the drive arrangement of the pump dry internally in the support means and with this to obtain easy access to the drive arrangement from the ship's deck. This is achieved while the rotor portion of the pump is arranged submerged in the cargo medium ready for pumping. At the same time, any contact between the cargo medium in the cargo tank and the pump medium/lubricating medium in the drive arrangement can be avoided. It will also be possible from the dismounted condition of the drive arrangement to couple together the drive arrangement and the rotor of the pump by simple means, that is to say by means of simple control and guide means between the support means and the drive arrangement, so that the intended drive connection is obtained by simple means.

According to the invention there are possibilities for lifting out the drive arrangement separately for examination and the like at the same time as sealing between the cargo medium and the atmosphere and the engagement between the pump's rotor and the pump's stator are maintained by simple means.

Further features of the invention will be evident from the following description having regard to the accompanying drawings which illustrate a preferred embodiment of the solution according to the invention, employed in a special field, where it is of essential importance to achieve hermetic sealing between the cargo medium and the atmosphere and between the cargo medium and the drive medium/lubricating medium and in which.

Figure 1:
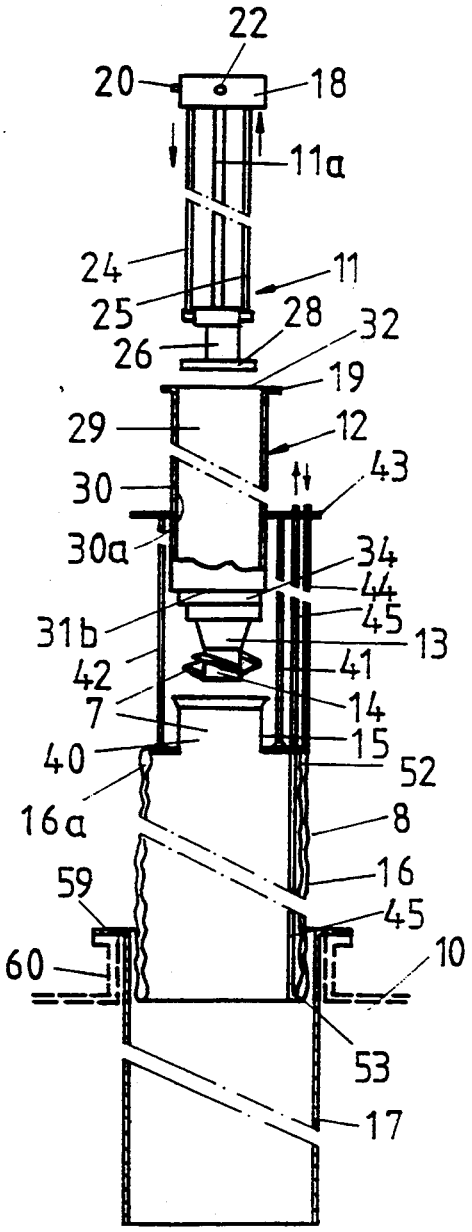
FIG. 1 shows schematically three different components which constitute the submersible pump with associated circulation system, illustrated with the members withdrawn from engagement with each other and with the members illustrated foreshortened for the sake of simplicity.
Figure 2:
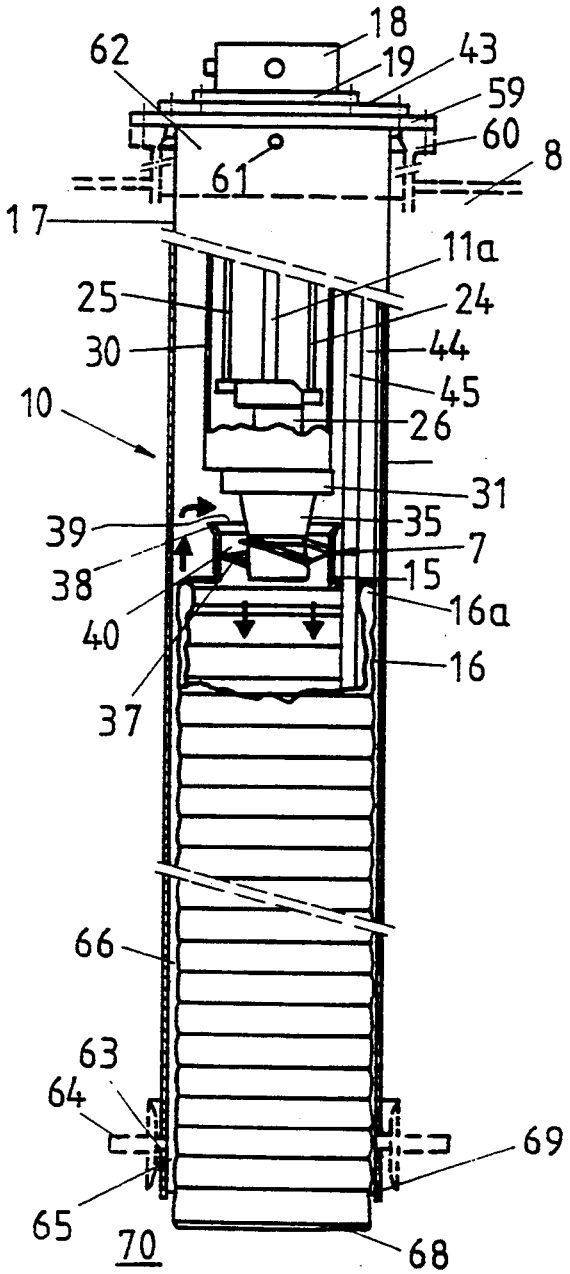
FIG. 2 shows in a vertical section a pump and circulation arrangement comprising the three components, as shown in FIG. 1, mounted in ready-for-use engagement with each other.

In FIGS. 1 and 2 there is shown a pump 7 which forms a part of a three-membered pump and circulation arrangement 8 which is submerged in a cargo medium 9 in a ship's tank 10. More specifically there is illustrated 1) a first component consisting of a drive arrangement 11 of a pump,
2) a second component consisting of a support means 12 with holder 13 for the rotor 14 of the pump fastened thereto together with
3) a third component consisting of stator 15 of the pump and a pipe-shaped cooling element 16 fastened thereto together with a surrounding jacket 17.

Figure 4:
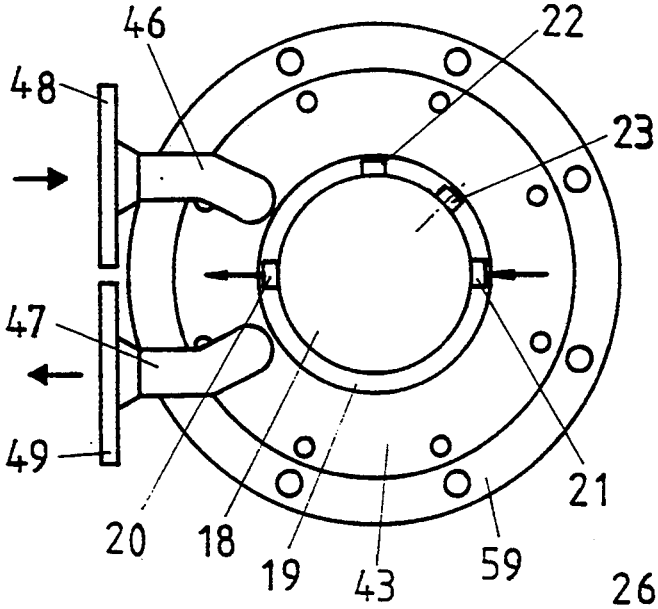

The first component, that is to say the drive arrangement 11, comprises a support head 18 which is adapted to be fastened to a support flange 19 directed radially outwards on the support means 12. In the support head 18 there are arranged, as shown in FIG. 4, two coupling unions 20, 21 for drive medium conduits (not shown further), that is to say a pressure medium conduit and a return conduit respectively, and two coupling unions 22, 23 for removal of medium which is drained from the drive arrangement. Additional details of the arrangements for removing drained medium from the support means 12 are not shown further, but can be formed in a manner known per se of suction equipment or other similar equipment.

Figure 5:
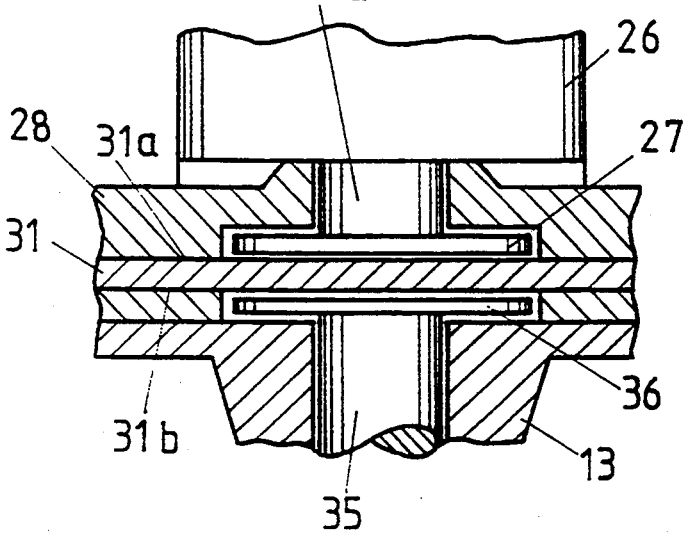
FIG. 5 shows in part the drive connection between the rotor and the drive motor.

The drive arrangement 11 comprises further two support means-forming connection conduits, that is to say a pressure medium conduit 24 and a return conduit 25 between the support head 18 and a hydraulic drive motor 26. There is employed in addition an extra support and shore strut 11*a* between the support head 18 and the drive motor 26. The drive motor 26 is as shown in FIG. 5 provided with a short drive shaft 26*a* with associated magnet disc 27 arranged within an inverted cup-shaped support and control member 28 which constitutes the lowermost portion of the drive arrangement.

The second component comprises the support means 12 which consists of a cylindrical, hermetic, well-forming member 29 with a non-perforated, cylindrical container wall 30 and a non-perforated, planar bottom 31, but with an open top 32, which is closed by the radially outwardly directed support flange 19, with which the support means 12 is hermetically sealed on deck. The bottom 31 of the support means 12 has an upwardly facing surface 31*a* which is adapted to form a support abutment for the support and control member 28 of the drive motor 26, while the inwardly facing surface 30*a* of its container wall 30 is adapted to form a guide for the support and control member 28 during displacement of the drive arrangement vertically in the support means 12 towards and from its bottom 31.

The second component comprises in addition to the support means 12, a unit of the holder 13 and the pump rotor 14. On the downwardly directed outer side 31*b* of the bottom 31 of the support means 12, the holder 13 for the pump rotor 14 is readily dismountably fastened via a fastening member 34. The pump rotor 14 is connected by means of a short shaft 35 to a magnet disc 36 which is adapted to cooperate with the magnet disc 27 of the drive motor 26 via the bottom 31 of the support means 12, the holder 13 being provided to position the magnet disc 36 at a suitable distance from the bottom 31 of the support means. The pump rotor 14 is designed with helical rotor blades 37.

The third component comprises an inner member consisting of the pump stator 15 and the cooling element 16 formed in one piece in the form of a substantially pipe-shaped construction and an outer member consisting of a pipe-shaped jacket 17.

The pump stator 15 comprises an upper guide portion 38 extending obliquely downwards and inwards, which defines an intake 39 to the pump between the holder 13 of the pump rotor 14 and a cylindrical pump chamber housing 40 disposed below in the pump stator 15. The pump stator 15 is provided at the lower edge of the pump chamber housing 40 with a radially outwardly extending end wall which is directly connected to upper edge portion 16*a* of the pipe-shaped cooling element 16 to form a coherent pipe-shaped construction with an open upper end at the pump intake and with an open lower end at the lower end of the cooling element 16. The coherent pipe-shaped construction is supported via support struts 41, 42 (FIG. 1) which are fastened above to a support flange 43 which is adapted to form a hermetic fastening for support flange 19 of the support means 12.

Figure 3:
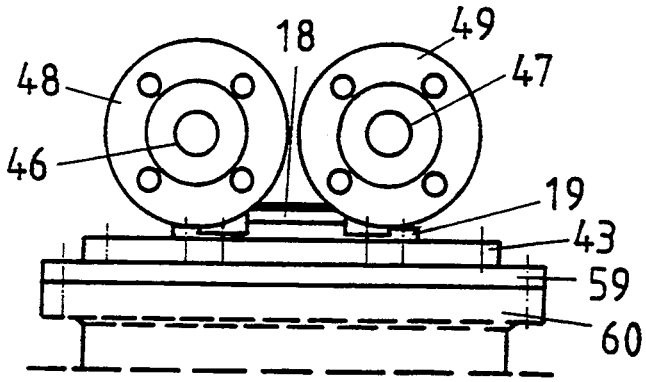
FIGS. 3 and 4 show a side view and a plan view respectively of an upper part of the pump and circulation arrangement according to FIG. 2.

The support flange 43 is, as shown in FIGS. 3 and 4, provided with pipe conduits 44, 45 from each of their respective coupling unions 46, 47 with associated coupling flanges 48, 49 for refrigeration medium conduits (not shown further) on deck.

Figure 6:
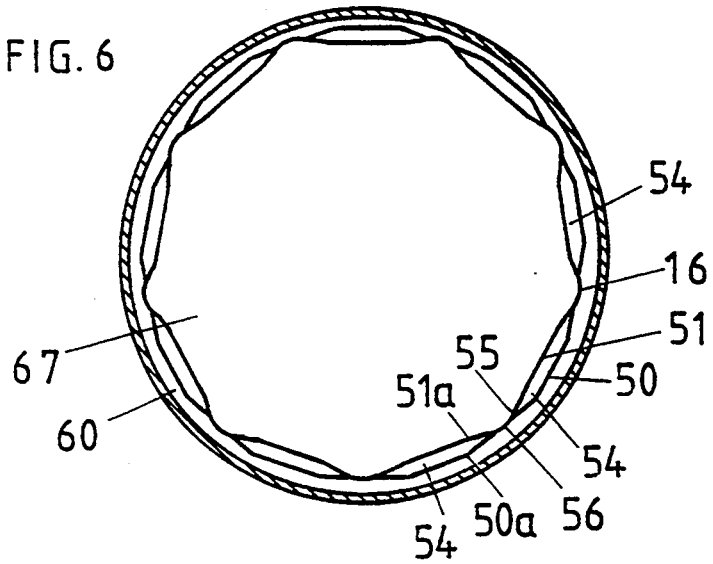
FIG. 6 shows a horizontal section of a cooling element which forms a part of relatively stationarily arranged member of the arrangement.
Figure 7:
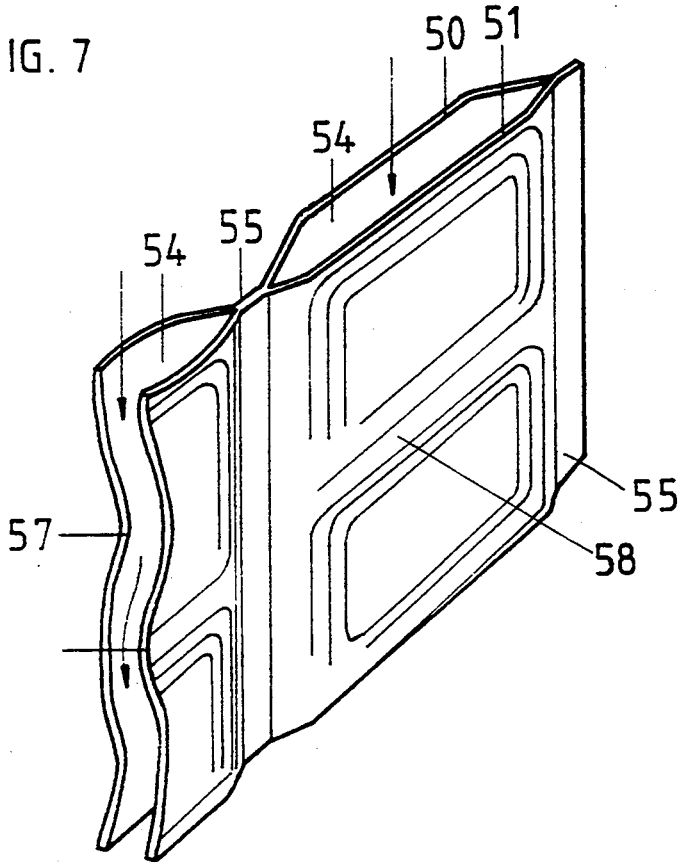
FIG. 7 shows in part a perspective view of the cooling element.

The cooling element 16, as shown in FIGS. 2, 6 and 7, is constructed in the illustrated embodiment of an external and an internal double-corrugated, shell-forming plate 50, 51 of rust-free steel. Above the plates 50, 51 are welded endways together, so that there is formed in the upper portion of the element an annular intake duct 52 connected to the conduit 44 which forms the intake conduit for refrigeration medium to the cooling element 16. Correspondingly the plates 50, 51 below are welded together endways, so that there is formed in the lower portion of the element an annular discharge duct 53 which is connected to the conduit 45, which forms the discharge conduit for refrigeration medium from the cooling element to the associated coupling union on deck. Between the ducts 52, 53, which are arranged within common vertically extending corrugating portions 50*a*, 51*a* of the plates 50, 51, there extend a series of vertically extending refrigeration medium ducts 54. The ducts 54 are mutually separated via rectilinear strip-shaped welds 55, as shown in FIG. 6, and provided with their respective associated, common break lines 56 along the weld 55. As is shown in FIG. 7 the ducts 54 extend in vertical section with a meanderingly shaped contour which is formed between mutually displaced, horizontal break lines 57, 58 in the two plates 50, 51, that is to say the horizontal corrugations in the one plate 50 extend mutually parallel to the horizontal corrugations in the remaining plate 51. The meanderingly shaped contour of the ducts 54 ensures a friction-promoting, favourable heat-transporting flow of the refrigeration medium internally in the ducts 54 and provides basis for an equivalently favourable flow of the medium which is to be cooled on opposite sides of the ducts.

The third component comprises in the illustrated embodiment as mentioned in addition to the inner pipe-shaped construction 15, 16 also the outer pipe-shaped jacket 17, which is separately suspended via a flange 59 on a hatchway coaming 60 on deck. The flange 59 forms a fastening for the flange 43, which carries the internal pipe-shaped construction 15, 16. The jacket 17 is fastened in the illustrated embodiment directly to the flange 59 and is provided just below the flange 59 with a passage having a back pressure valve 61, which is adapted to open with the occurrence of a significant reduced pressure in an upper chamber 62 within the jacket 17.

The jacket 17 is supported below via a collar 63 externally in a guide-forming control means 64 internally in the ship's tank 10. The cooling element 16 can correspondingly be provided at its lower end—at the level of the control means—with a series of peripherally separated control shoes 65 which form a support and control against the guide-forming inner side of the jacket 17. In the intermediate spaces between the control shoes, 65 there are formed ducts for the passage of the cargo medium to an annular passage 66 which is formed between the cooling element 16 and the jacket 17. The passage 66, which over the major portion of the height dimension of the element 16 has a uniform, relatively narrow cross-sectional area distributed over a relatively large periphery on the outer side of the element 16, forms together with the jacket 17 the primary cooling zone of the cooling element, based on a relatively large rate of motion for the cargo medium in said primary cooling zone. In an inner duct 67, which is formed radially within the circulation system receiving the refrigeration medium of the element 16, there is defined a substantially larger cross-sectional area which produces an equivalently lower rate of motion for the cargo medium. By allowing an outlet 68 from the cooling element 16 to project a distance vertically below an intake 69 to the passage 66, the main flow of the refrigerated cargo medium from the duct 67 can be controlled outside the feed region 70 to the intake 69 of the passage 66. However a lively turbulence of the cargo medium can be anticipated in the region vertically below and radially outside the lower end of the cooling element 16 as a result of the currents with an opposite flow direction and with a substantially different rate of motion. In addition the difference between non-refrigerated cargo medium and refrigerated cargo medium produces extra current movements in the cargo.

In addition to the refrigeration which occurs in the passage 66, that is to say in the primary cooling region, there also occurs a certain cooling down of the cargo medium in the secondary cooling zone which is formed by the duct 67. In addition there also occurs a certain cooling down of the upper region of the cooling element 16, where the cargo medium in the passage 66 is relatively heavily refrigerated. In practice the temperature difference of the cargo medium, which is fed to the intake 69 of the passage 66, needs not be large relative to the cargo medium, which is emptied from the duct 67 at the outlet 68. By employing according to the invention a step-free regulatable, hydraulic drive motor 26 the rate of flow of the cargo medium can be regulated through the combined refrigeration and circulation arrangement, in order thereby to regulate the heat transfer from the cargo medium to the refrigeration arrangement. In addition there is also the possibility to regulate separately the quantity of refrigeration medium supplied to the refrigeration arrangement. An important advantage according to the invention consists in that the whole circulation arrangement and associated refrigeration arrangement are submerged in the cargo medium and can be temperature controlled in the latter and that only the drive arrangement of the pump needs to be exposed to the atmosphere and can thereby be temperature controlled relative to the latter.

As is shown in FIG. 2 the flanges 59, 43 and 19 and the support head 18 are fastened concentrically the one outside the other and fastened in pairs to each other. This involves the associated components in certain contexts being able to be handled as a coherent unit consisting of refrigeration arrangement, pump and its drive arrangement. In addition the components can be dismounted in other contexts as required, for example by dismounting the drive arrangement separately or by dismounting the drive arrangement with associated support means and pump rotor as a separate unit or by dismounting the other components collectively relative to the jacket 17, as should be rendered clear by the mutually withdrawn components as illustrated in FIG. 1.

I claim:

1. A submersible pump comprising a first component for mounting in a hold of a ship, said component including a stator and a cooling element for cooling a flow of liquid from said stator;

a second component removably mounted on said first component, said second component including a cylindrical support having a closed lower end and an open upper end and a rotor mounted on said lower end concentrically of and within said stator for pumping liquid in the hold through said stator and over said cooling element; and a third component removably mounted on and in said second component, said third component including a drive disposed within said cylindrical support for effecting rotation of said rotor.

2. A submersible pump as set forth in claim 1 wherein said drive includes a first magnetic disk and a hydraulic motor for rotating said disk and wherein said rotor is connected to a second magnetic disc spaced from and driven by said first magnetic disk.

3. A submersible pump as set forth in claim 1 wherein said stator has an angled intake for guiding of said rotor into and out of said stator during assembly and disassembly.

4. A submersible pump as set forth in claim 1 which further comprises a pipe-shaped jacket concentrically receiving said first component, said second component and said third component.

5. A submersible pump as set forth in claim 4 wherein said cooling element is cylindrical and is spaced concentrically from said jacket to define an annular space therewith for an upward flow of liquid to said stator.

6. A submersible pump as set forth in claim 5 wherein said cylindrical cooling element projects below said jacket.

7. A submersible pump as set forth in claim 5 wherein said cooling element has a plurality of vertically extending ducts for conveying a refrigerant therethrough in heat exchange with a liquid flowing through said annular space and a liquid flowing coaxially through said cooling element.

8. A submersible pump as set forth in claim 7 wherein said cooling element includes a pair of vertically corrugated concentric shells disposed in contacting relation to define said vertical ducts therebetween, each said shell having horizontally disposed corrugations within each said vertical duct.

9. In combination, a hatchway coaming on a deck of a ship;

a cylindrical jacket mounted on said coaming and depending therefrom into a hold of the ship;

a first pump component disposed in said jacket and including a cylindrical stator and an annular cooling element depending from said stator in spaced relation to said jacket to define an annular space therebetween;

a second pump component disposed in said jacket and including a cylindrical support and a rotor disposed concentrically within said stator and depending from said cylindrical support; and a third pump component removably mounted on said coaming and depending into said cylindrical support of said second pump component, said third pump component including a drive for effecting rotation of said rotor within said stator.

10. The combination as set forth in claim 9 wherein said drive includes a first magnetic disk and a hydraulic motor for rotating said disk and wherein said rotor is connected to a second magnetic disc spaced from and driven by said first magnetic disk.

11. The combination as set forth in claim 9 wherein said cooling element has a plurality of vertically extending ducts for conveying a refrigerant therethrough in heat exchange with a liquid flowing through said annular space and a liquid flowing coaxially through said cooling element.

12. The combination as set forth in claim 11 wherein said cooling element includes a pair of vertically corrugated concentric shells disposed in contacting relation to define said vertical ducts therebetween, each said shell having horizontally disposed corrugations within each said vertical duct.

* * * * *